US010214848B2

(12) United States Patent
Leitert et al.

(10) Patent No.: US 10,214,848 B2
(45) Date of Patent: Feb. 26, 2019

(54) METHODS OF DETERMINING A LOAD SIZE IN A LAUNDRY TREATING APPLIANCE

(71) Applicant: WHIRLPOOL CORPORATION, Benton Harbor, MI (US)

(72) Inventors: Andrew Leitert, Eau Claire, MI (US); Karl David McAllister, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 120 days.

(21) Appl. No.: 15/191,698

(22) Filed: Jun. 24, 2016

(65) Prior Publication Data

US 2016/0305058 A1 Oct. 20, 2016

Related U.S. Application Data

(63) Continuation of application No. 13/908,020, filed on Jun. 3, 2013, now Pat. No. 9,416,479.

(51) Int. Cl.
*D06F 39/00* (2006.01)

(52) U.S. Cl.
CPC ..... *D06F 39/003* (2013.01); *D06F 39/005* (2013.01)

(58) Field of Classification Search
CPC ..... D06F 39/003; A47L 15/00–15/508
See application file for complete search history.

(56) References Cited

U.S. PATENT DOCUMENTS

| | | | |
|---|---|---|---|
| 6,842,532 | B2 | 1/2005 | Hu et al. |
| 7,380,423 | B1 | 6/2008 | Musone |
| 7,601,978 | B2 | 10/2009 | Sari-Sarraf et al. |
| 8,229,204 | B2 | 7/2012 | Wagner |
| 2001/0049846 | A1 | 12/2001 | Guzzi et al. |
| 2007/0181162 | A1 | 8/2007 | Classen et al. |
| 2010/0205819 | A1 | 8/2010 | Ashrafzadeh et al. |
| 2010/0205820 | A1 | 8/2010 | Ashrafzadeh et al. |
| 2010/0205823 | A1 | 8/2010 | Ashrafzadeh et al. |
| 2010/0205825 | A1 | 8/2010 | Ashrafzadeh et al. |
| 2010/0205826 | A1 | 8/2010 | Ashrafzadeh et al. |
| 2011/0153086 | A1* | 6/2011 | Bellinger |
| 2012/0110749 | A1 | 5/2012 | Park et al. |

(Continued)

FOREIGN PATENT DOCUMENTS

| | | | |
|---|---|---|---|
| DE | 3804624 | A1 | 8/1989 |
| EP | 0544945 | A1 | 6/1993 |
| EP | 2559800 | A2 | 2/2013 |

(Continued)

OTHER PUBLICATIONS

European Search Report for Corresponding EP14169495.0, dated Oct. 13, 2014.

(Continued)

*Primary Examiner* — Spencer E Bell

(57) ABSTRACT

Methods of determining a laundry load size in a laundry treating appliance comprising a rotatable drum at least partially defining a treating chamber for receiving laundry for treatment in accordance with a treating cycle of operation, at least one imaging device, and a controller having a processor, the method includes generating multiple images and determining, by the controller, a load size based on the multiple images.

18 Claims, 4 Drawing Sheets

(56) References Cited

U.S. PATENT DOCUMENTS

2012/0138092 A1 6/2012 Ashrafzadeh et al.

FOREIGN PATENT DOCUMENTS

| | | | |
|---|---|---|---|
| FR | 2894996 | A1 | 6/2007 |
| GB | 2458927 | A | 10/2009 |
| JP | 4244193 | A | 9/1992 |
| JP | H04244193 | A | 9/1992 |
| JP | 2991511 | B2 | 12/1999 |
| JP | 2002224486 | A | 8/2002 |
| NZ | 535898 | A | 10/2006 |

OTHER PUBLICATIONS

European Search Report for Corresponding EP14169498.4, dated Oct. 15, 2014.

* cited by examiner

METHODS OF DETERMINING A LOAD SIZE IN A LAUNDRY TREATING APPLIANCE

CROSS-REFERENCE TO RELATED APPLICATIONS

This application is a continuation of U.S. patent application Ser. No. 13/908,020 filed on Jun. 3, 2013, now U.S. Pat. No. 9,416,479 issued Aug. 16, 2016, entitled METHODS OF DETERMINING A LOAD SIZE IN A LAUNDRY TREATING APPLIANCE, which is hereby incorporated by reference in its entirety.

BACKGROUND

Laundry treating appliances, such as clothes washers, clothes dryers, refreshers, and non-aqueous systems, may have a configuration based on a rotating drum that defines a treating chamber in which laundry items are placed for treating according to one or more cycles of operation. The laundry treating appliance may have a controller that implements the cycles of operation having one or more operating parameters. The cycles of operation may vary according to the size of the laundry load in the drum. The size of the laundry load may be manually input by the user through a user interface. Oftentimes a user will overestimate or underestimate the load size, thereby resulting in a less than optimal treating performance. Furthermore, laundry treating appliances currently measure mass but this may not provide a full understanding of the load size and may cause confusion for the user when mass is indicated.

BRIEF SUMMARY

In one aspect the present disclosure relates to a method of determining a laundry load size in a laundry treating appliance comprising a rotatable drum at least partially defining a treating chamber for receiving laundry for treatment in accordance with a treating cycle of operation, at least one imaging device, and a controller having a processor, the method comprising rotating the rotatable drum, generating multiple images of a laundry load within the treating chamber, from a single imaging device, where the generated multiple images are from different viewpoints of the laundry load and determining, by the controller, a load size based on the multiple images.

In another aspect the present disclosure relates to a method of determining a laundry load size in a laundry treating appliance comprising a rotatable drum at least partially defining a treating chamber for receiving laundry for treatment in accordance with a treating cycle of operation, at least one imaging device, and a controller having a processor, the method comprising rotating the rotatable drum, generating at a same time, multiple images of a laundry load within the treating chamber where the multiple images are generated from different locations within the treating chamber, and determining, by the controller, a load size based on the multiple images.

In yet another aspect, the present disclosure relates to a method of determining a laundry load size in a laundry treating appliance comprising a rotatable drum at least partially defining a treating chamber for receiving laundry for treatment in accordance with a treating cycle of operation, at least one imaging device, and a controller having a processor, the method comprising generating image data of a laundry load within the treating chamber, from a set of imaging devices, determining, by the controller, a load size based on the image data, and setting, by the controller, at least one operating parameter of the treating cycle of operation based on the determined load size, wherein the generating of the image data begins when a user opens or closes a door of the laundry treating appliance or at a start of a user selected treating cycle of operation.

DESCRIPTION OF EMBODIMENTS OF THE INVENTION

Figure 1:
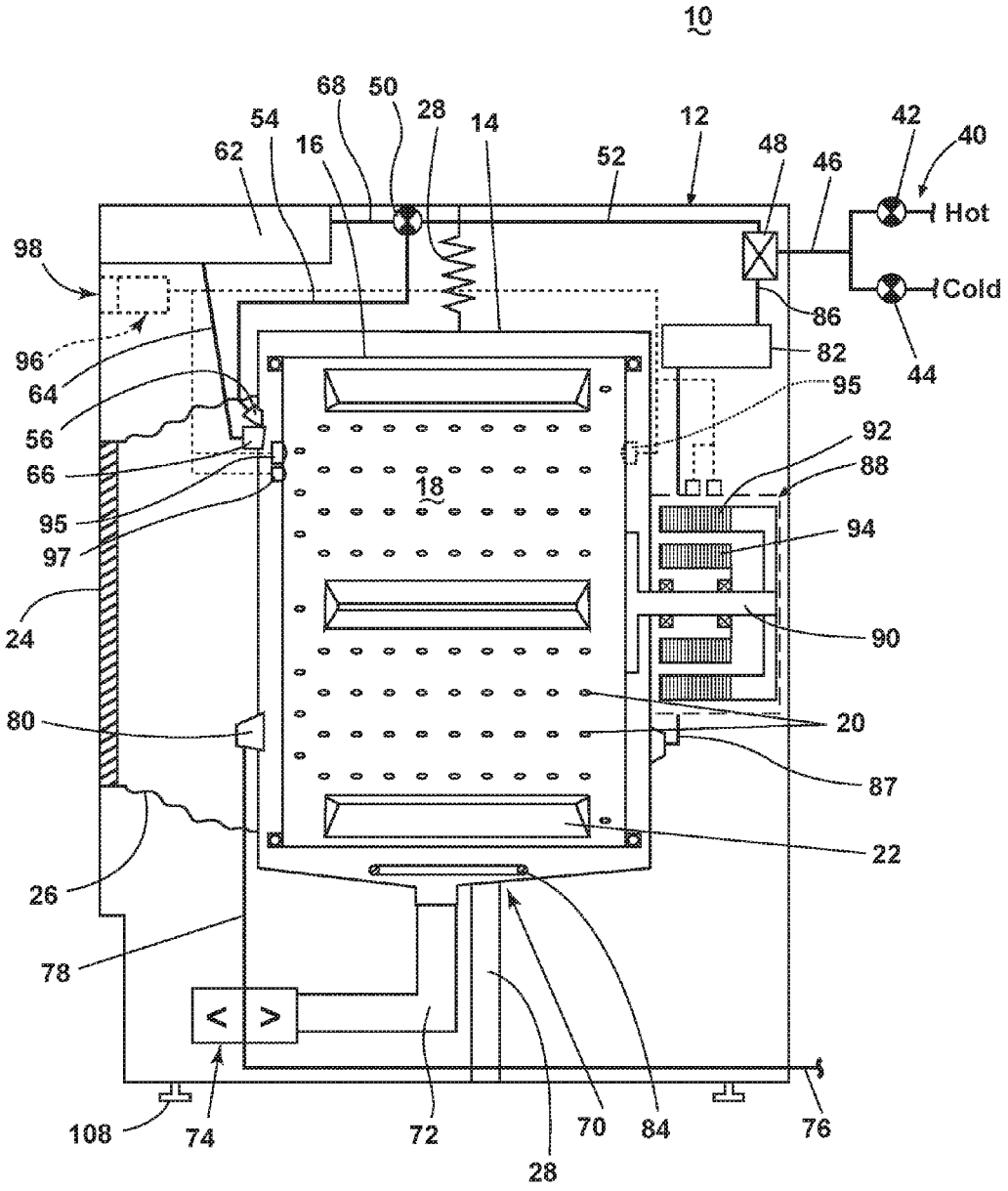
FIG. 1 is a schematic view of a laundry treating appliance in the form of a washing machine.

FIG. 1 is a schematic view of a laundry treating appliance that may implement an embodiment of a method of the invention. The laundry treating appliance may be any appliance which performs a cycle of operation to clean or otherwise treat items placed therein, non-limiting examples of which include a horizontal or vertical axis clothes washer; a combination washing machine and dryer; a dispensing dryer; a tumbling or stationary refreshing/revitalizing machine; an extractor; a non-aqueous washing apparatus; and a revitalizing machine.

As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

The laundry treating appliance of FIG. 1 is illustrated as a horizontal-axis washing machine 10, which may include a structural support system including a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system includes a tub 14 supported within the cabinet 12 by a suitable suspension system and a drum 16 provided within the tub 14, the drum 16 defining at least a portion of a laundry treating chamber 18 for receiving a laundry load for treatment. The drum 16 may include a plurality of perforations 20 such that liquid may flow between the tub 14 and the drum 16 through the perforations 20.

A plurality of baffles 22 may be disposed on an inner surface of the drum 16 to lift the laundry load received in the treating chamber 18 while the drum 16 rotates. It may also be within the scope of the invention for the laundry holding system to include only a tub with the tub defining the laundry treating chamber.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may also include at least one balance ring 38 containing a balancing material moveable within the balance ring 38 to counterbalance an imbalance that may be caused by laundry in the treating chamber 18 during rotation of the drum 16. More specifically, the balance ring 38 may be coupled with the rotating drum 16 and configured to compensate for a dynamic imbalance during rotation of the rotatable drum 16. The balancing material may be in the form of balls, fluid, or a combination thereof. The balance ring 38 may extend circumferentially around a periphery of the drum 16 and may be located at any desired location along an axis of rotation of the drum 16. When multiple balance rings 38 are present, they may be equally spaced along the axis of rotation of the drum 16. For example, in the illustrated example a plurality of balance rings 38 are included in the washing machine 10 and the plurality of balance rings 38 are operably coupled with opposite ends of the rotatable drum 16.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single use and bulk dispenser.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through the tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88 for rotationally driving the drum 16. The motor 88 may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled with the drum 16 through a belt and a drive shaft to rotate the drum 16, as is known in the art. Other motors, such as an induction motor or a permanent split capacitor (PSC) motor, may also be used. The motor 88 may rotationally drive the drum 16 including that the motor 88 may rotate the drum 16 at various speeds in either rotational direction.

A first imaging device 95 has been illustrated as being located near the door 24 while a second optional imaging device 95 (shown in phantom) has been illustrated as being located near the back of the drum 16. The imaging device(s) 95 may be configured to image the treating chamber 18 and/or anything within the treating chamber 18. It will be understood that any number of imaging devices 95 may be included in the washing machine 10 and that they may be located in any suitable locations so that the treating chamber 18 may be imaged.

Exemplary imaging devices 95 may include any optical sensor capable of capturing still or moving images, such as a camera. One suitable type of camera may be a CMOS camera. Other exemplary imaging devices include a CCD camera, a digital camera, a video camera, or any other type of device capable of capturing an image. That camera may capture either or both visible and non-visible radiation. For example, the camera may capture an image using visible light. In another example, the camera may capture an image using non-visible light, such as ultraviolet light. In yet another example, the camera may be a thermal imaging device capable of detecting radiation in the infrared region of the electromagnetic spectrum. The imaging device(s) 95 may be located on either of the rear or front bulkhead, in the door 24, or on the drum 16. It may be readily understood that the location of the imaging device(s) 95 may be in numerous other locations depending on the particular structure of the washing machine 10 and the desired position for obtaining an image. The location of the imaging device may depend on the type of desired image, the area of interest within the treating chamber 18, or whether the image may be captured with the drum in motion. For example, if the drum 16 is to be stopped during imaging and the laundry load is of interest, the imaging device(s) 95 may be positioned so that a field of view of the imaging device 95 includes the bottom of the drum 16. The imaging device(s) 95 may also be placed such that the entire or substantially the entire treating chamber 18 is within the field of view of the imaging device(s) 95. In the case of multiple imaging devices 95 the multiple imaging devices may image the same or different areas of the treating chamber 18 and may provide images at varying angles and views.

An illumination source 97 may also be included to illuminate a portion of the laundry treating chamber 18. The type of illumination source 97 may vary. In one configuration, the illumination source 97 may be an incandescent light, one or more LED lights, etc. The illumination source 97 may also be located in any suitable location. While only a single illumination source 97 has been illustrated any number of illumination sources may be included including that an array of LED lights may be placed at multiple positions on a front bulkhead. Regardless of the use of the illumination device 97, at any instant in time, a given location in an image will be dark or light depending on whether or not laundry is present at that location. The illumination generated by the illumination source may vary, and may well be dependent on the type of imaging device. For example, the illumination may be infrared if the imaging device may be configured to image the infrared spectrum. Similarly, the illumination may be visible light, if the imaging device may be configured to image the visible spectrum.

The washing machine 10 also includes a control system for controlling the operation of the washing machine 10 to implement one or more cycles of operation. The control system may include a controller 96 located within the cabinet 12 and a user interface 98 that may be operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It is contemplated that the controller may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
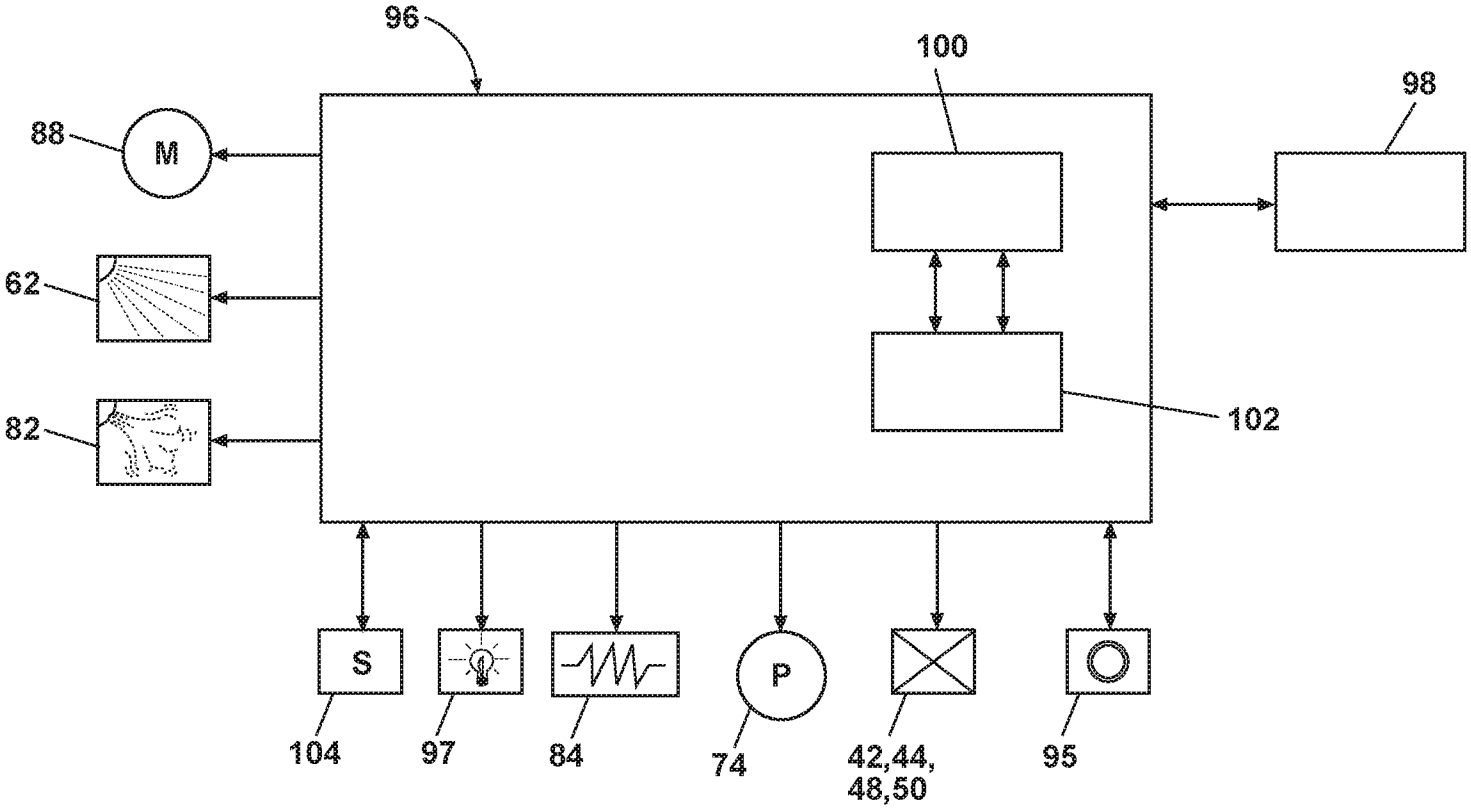
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102. The memory 100 may be used for storing the control software that may be executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, an imbalance sensor, a load size sensor, and a motor torque sensor, which may be used to determine a variety of system and laundry characteristics, such as laundry load inertia or mass.

The controller 96 may also be coupled with the imaging device(s) 95 to capture one or more images of the treating chamber 18. The controller 96 may operate the illumination source 97 at the same although this need not be the case as the imaging device(s) 95 may capture images without the use of the illumination source 97. The captured images may be sent to the controller 96 and analyzed using analysis software stored in the memory 100 of the controller 96 to detect laundry within the treating chamber 18. The controller 96 may use the detection of the laundry to determine a load size of the laundry within the treating chamber 18.

Figure 3:
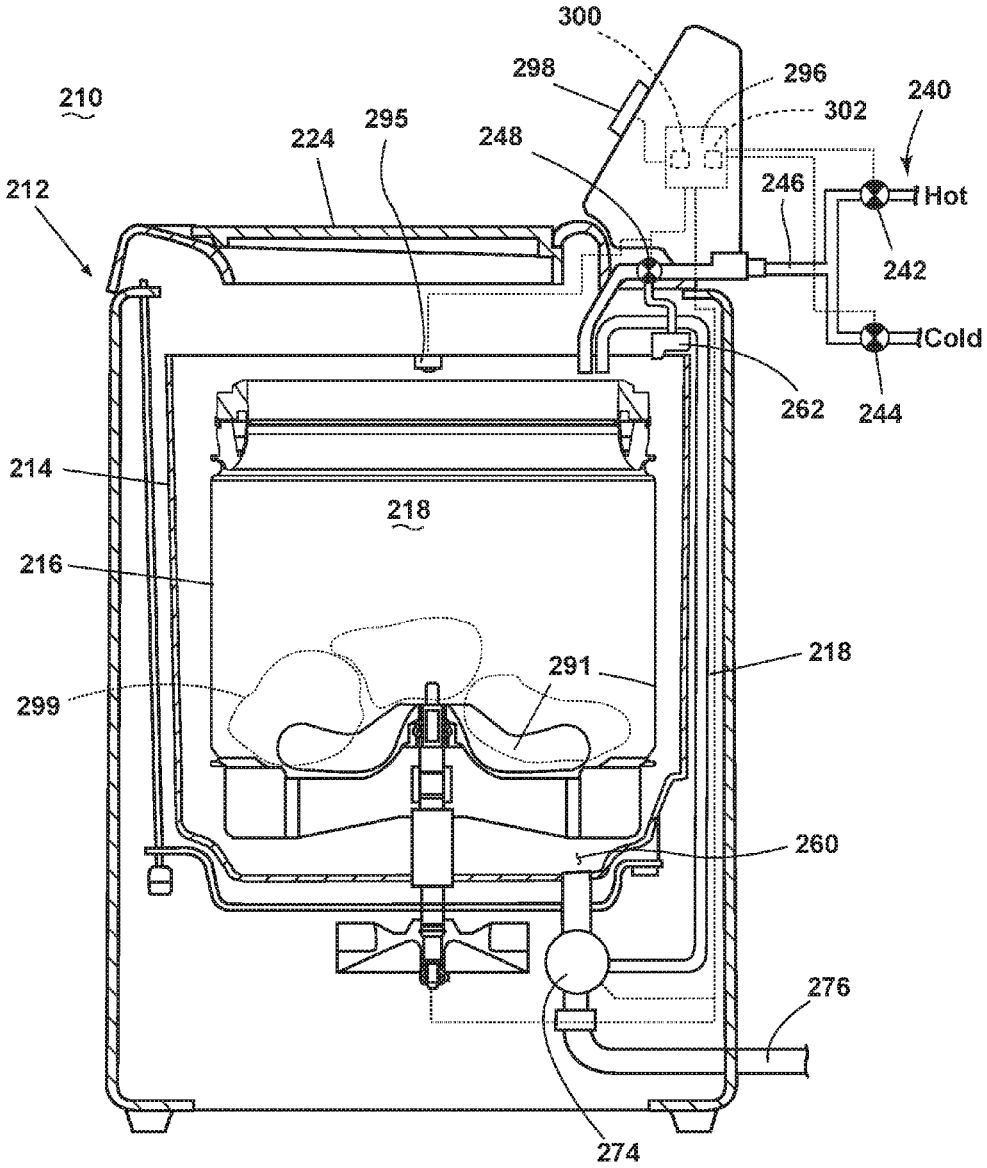
FIG. 3 is a schematic view of a laundry treating appliance in the form of an alternative washing machine.

FIG. 3 illustrates an alternative laundry treating appliance in the form of a vertical-axis washing machine 210. The vertical axis washing machine 210 is similar to the horizontal-axis washing machine 10 illustrated in FIG. 1. Therefore, like parts will be identified with like numerals increased by 200, with it being understood that the description of the like parts of the horizontal-axis washing machine applies to the vertical-axis washing machine embodiment, unless otherwise noted.

Unlike the earlier described washing machine 10, the washing machine 210 includes a perforated, open top drum 216 rotatably mounted inside the wash tub 214 and includes an agitator 291 or other type of clothes load and/or wash liquid mover rotatably mounted therein, as is well known in the washing machine art. Like the earlier described appliance, one or more imaging device(s) 295 may be included in the washing machine 210 and may be configured to image the treating chamber 218 and/or anything within the treating chamber 218. Only a single imaging device 295 has been illustrated; however, it will be understood that any number of imaging devices 295 may be included. The imaging device(s) 295 may be located in any suitable location so that it may image the treating chamber 218 including on the door 224, on a portion of the tub 214, or on a portion of the drum 216. Further, while no illumination sources have been included one or more illumination sources may be included.

As with the earlier described embodiment, the controller 296 may also be coupled with the imaging device 295 to capture multiple images of the treating chamber 218 and any laundry 299 therein. The captured images may be sent to the controller 296 and analyzed using analysis software stored in the controller memory 300 to detect laundry 299 in the generated image. The controller 296 may use the detection of the laundry 299 to determine a load size of the laundry 299 within the treating chamber 218.

Figure 4:
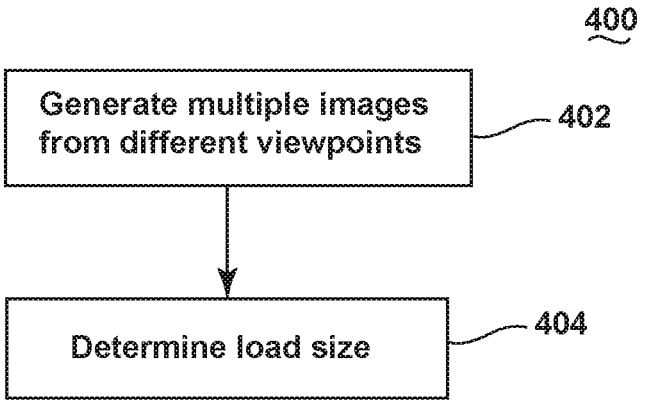
FIG. 4 is a flow chart illustrating a method of operating the washing machines of FIGS. 1 and 3.

Referring now to FIG. 4, a flow chart of a method 400 for determining a laundry load size in a laundry treating appliance, such as the washing machine 10 and the washing machine 210, is illustrated. While each of the washing machines may implement the method 400, for ease of explanation the method 400 will be explained with respect to the washing machine 10. The sequence of steps depicted for this method is for illustrative purposes only, and is not meant to limit the method in any way as it is understood that the steps may proceed in a different logical order or additional or intervening steps may be included without detracting from the invention. The method 400 may be implemented in any suitable manner, such as automatically or manually, as a stand-alone phase or cycle of operation or as a phase of an operation cycle of the washing machine 10. The method 400 may also be implemented while a user may be loading the washing machine 10 to aid in alerting the user as to the size of the laundry load in the washing machine 10. For example, the method 400 may start at step 402 while the user may be loading the washing machine 10 with one or more articles to form the laundry load, or when the laundry load may be loaded into the washing machine 10. The method 400 may be initiated automatically when the user opens or closes the door 24, or at the start of a user selected operating cycle.

At 402, multiple images of the laundry load within the treating chamber 18 may be generated. The multiple images may be from different viewpoints of the load. This may be accomplished in a variety of ways. For example, multiple images may be generating from multiple imaging devices, such as the two imaging devices 95, this allows the multiple images to be generated from different locations within the treating chamber 18. The multiple images may be generated at a same time or different times.

Alternatively, generating the multiple images may include generating the multiple images by a single imaging device 95. Because the multiple images may be from different viewpoints of the load, the multiple images may be at different predetermined rotational positions of the drum. For example, an image may be taken, the controller 96 may rotate the drum 16 to a different predetermined rotational position through operation of the motor 88 and the laundry in the drum 16 may shift giving a different viewpoint of the load and another image may be taken. The imaging, rotating, and imaging may be repeated to obtain any number of different images of different viewpoints of the load. It is contemplated that the predetermined rotational positions of the drum 16 may not be equidistant. Alternatively, the imaging device 95 may be capable of movement and the multiple images may be from different angles of the laundry load. Any number of multiple images may be generated including that the multiple images may include as few as two images.

At 404, the controller 96 may detect laundry in the generated image and determine a size of the laundry load based on the detected laundry. The detecting may be done by having the generated image undergo image analysis. The generated image may be sent to the controller 96 for image analysis using software that may be stored in the memory of the controller 96. The controller 96 may apply an algorithm to process the image. The algorithm may be implemented as a set of executable instructions that may be carried out by the CPU 102 in the controller 96. It may also be within the scope of the invention for the imaging device(s) 95 to have a memory and a microprocessor for storing information and software and executing the software, respectively. In this manner, the imaging device(s) 95 may analyze the captured image data and communicate the results of the analysis with the controller 96. In one exemplary type of image analysis, the laundry load may be isolated from the background, i.e. the drum 16, of the captured image. The isolated laundry load may be used to calculate the edge, volume, area, perimeter, radius and major or minor axis of the load using known methods. For example, the controller 96 may know the field of view of the imaging device(s) 95 and may estimate the size of the load based on where laundry has been detected in the generated image.

Determining the load size based on the multiple images may include putting the multiple images together to analyze them and determine the size of the laundry load. A 3D model of the laundry load may be determined based on the multiple images and the size of the laundry load may be determined therefrom. The 3D model of the laundry load may be determined utilizing a computer algorithm stored on memory 100 in the controller 96 and executed by a computer processing unit of the controller 96. Any suitable technique may be utilized to form the 3D model from at least two images including any photogrammetry technique.

A load type may be determined based on the determined 3D model of the laundry load. More specifically, different types of laundry items are known to lie differently and the laundry type may be determined based on such knowledge. For example, mountains and valleys in the laundry load may be determined and the type of the load may be determined based on the mountains and valleys. Delicate fabric would lie more flat whereas a jeans load would have more mountains and valleys because they are of stiffer construction.

Determining the load size may include determining a height of the laundry load based on the multiple images. Further, determining the load size may include estimating a volume of the laundry load based on the determined height. It is also contemplated that with determining the loads and valleys that multiple heights within the drum 16 may be calculated to more accurately estimate the volume of the laundry load. Further, the 3-D model may be used to generate a surface topology of the mountains and valleys relative to a reference height, such as the top of the drum 16. Given the reference point and that the volume of the treating chamber 18 is known, the solid volume underlying the generated surface may be determined and the volume of the surface topology added to the underlying volume to determine a load size.

It will be understood that the method of determining the laundry load size may be flexible and that the method illustrated above is merely for illustrative purposes. For example, regardless of which laundry treating appliance may be utilized including how many imaging devices the laundry treating appliance has, the controller may use the determined load size to set one or more operating parameters of the treating cycle of operation to control the operation of at least one component with which the controller may be operably coupled with to complete a cycle of operation. For example, the parameter that may be set may include a cycle time, an air flow rate in the treating chamber, a wash liquid fill level, a tumble pattern, an amount of treating chemistry, a type of treating chemistry, etc. The controller may also indicate a variety of information through the user interface based on the determined load size including the set cycle time and the determined load size. Furthermore, a type of laundry within the laundry load may be determined from the images. Such information may also be utilized in setting a parameter of the cycle of operation. Further still information regarding the load may be transferred to a dryer or other laundry treating appliance where the laundry load may be intended to be subsequently transferred to.

The above described embodiments provided a variety of benefits including that the size of the load may more accurately be determined. Currently laundry treating appliances only measure a mass of the laundry load while users loads according to volume or how full they perceive the laundry treating appliance to be. Applying a strict mass sensor may be problematic for capacity detection because if a comforter which weighs about four pounds but is very voluminous is placed inside a washing machine the mass sensor would indicate that it is only a quarter full by mass but by volume it is taking up the entire space inside the drum. The customer may then get confused by the mass sensor and think that it is acceptable to put more fabric inside, which could reduce cleaning performance, cause the motor to overheat, etc. The above embodiments allow for a size determination of the laundry load that provides a good user experience. Further the above embodiments may be used to determine load type and may allow cycle parameters to be more accurately determined, which may result in energy, water consumption, and time savings as well as allowing the laundry treating appliance to be operated in an effective and efficient manner To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. Further, it will be understood that any suitable image generation techniques may be used including that generating the image may include generating at least one of a still image or a video and may include capturing a digital image. Further, the image may be a visible light image, an ultraviolet light image, an infrared image, etc.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of determining a laundry load size in a laundry treating appliance comprising a rotatable tub or rotatable drum at least partially defining a treating chamber for receiving laundry for treatment in accordance with a treating cycle of operation, at least one imaging device, and a controller having a processor, the method comprising:

rotating the rotatable tub or the rotatable drum;

generating multiple images of a laundry load within the treating chamber, from a single imaging device, where the generated multiple images are from different viewpoints of the laundry load;

combining, by the controller, the multiple images together to define a composite;

analyzing, by the controller utilizing a computer algorithm, the composite to define a 3D model of the laundry load including mountains and valleys in the laundry load;

determining, by the controller, multiple heights defining the mountains and valleys in the laundry load; and determining a load size based on the 3D model including the multiple heights defining the mountains and valleys in the laundry load.

2. The method of claim 1 wherein rotating the rotatable drum comprises rotating the rotatable drum below a tumbling speed.

3. The method of claim 1, further comprising determining a load type based on the 3D model of the laundry load.

4. The method of claim 1 wherein the multiple images comprise two images.

5. The method of claim 1, further comprising setting at least one parameter of the treating cycle of operation based on the determined load size.

6. The method of claim 5 wherein the at least one parameter is a cycle time, an air flow rate in the treating chamber, a wash liquid fill level, or an amount of treating chemistry.

7. The method of claim 6 wherein generating the multiple images comprises generating the multiple images at different predetermined rotational positions of the rotatable drum.

8. The method of claim 6, further comprising displaying on a user interface of the appliance a set cycle time based on the determined load size.

9. The method of claim 7 wherein the predetermined rotational positions of the rotatable drum are not equidistant.

10. A method of determining a laundry load size in a laundry treating appliance comprising a rotatable tub or rotatable drum at least partially defining a treating chamber for receiving laundry for treatment in accordance with a treating cycle of operation, at least one imaging device, and a controller having a processor, the method comprising:

rotating the rotatable tub or the rotatable drum;

generating multiple images of a laundry load within the treating chamber, from a single imaging device, where the generated multiple images are from different viewpoints of the laundry load;

combining, by the controller, the multiple images together to define a composite;

analyzing, by the controller, the composite to define a surface topology of mountains and valleys of the laundry load within the treating chamber relative to a predetermined reference height of the rotatable tub or the rotatable drum; and determining, by the controller, a load size based on the surface topology by comparing the surface topology to the reference height and determining a volume of the laundry load based on the comparing.

11. The method of claim 10 wherein the multiple images comprise two images.

12. The method of claim 10 wherein determining the volume of the laundry load comprises determining a solid volume underlying the surface topology in addition to the volume of the surface topology.

13. The method of claim 10 wherein the reference height is a top of the drum.

14. The method of claim 10, further comprising determining multiple heights of the mountains and valleys of the laundry load within the drum and determining a volume of the laundry load therefrom.

15. The method of claim 10, further comprising determining a load type based on the mountains and valleys of the laundry load.

16. The method of claim 10, further comprising displaying on a user interface of the appliance a set cycle time based on the determined load size.

17. The method of claim 10 wherein rotating the rotatable drum comprises rotating the rotatable drum below a tumbling speed.

18. The method of claim 10 wherein generating the multiple images comprises generating the multiple images at different predetermined rotational positions of the rotatable drum.

* * * * *